United States Patent [19]

Andre et al.

[11] 4,300,728

[45] Nov. 17, 1981

[54] APPARATUS FOR PACKAGING STRAND

[75] Inventors: Gerald R. André, Monroeville, Pa.; David C. Wingate, Amarillo, Tex.; Thomas O. Matteson, Columbus, Ohio

[73] Assignee: Owens-Corning Fiberglas Corporation, Toledo, Ohio

[21] Appl. No.: 154,250

[22] Filed: May 29, 1980

[51] Int. Cl.[3] ..... B65H 54/02

[52] U.S. Cl. ..... 242/18 A; 242/18 G; 242/18 PW

[58] Field of Search ..... 242/18 G, 18 A, 18 PW, 242/25 A

[56] References Cited

U.S. PATENT DOCUMENTS 4,057,195 11/1977 Jones et al. ..... 242/18 G 4,085,901 4/1978 Sanders ..... 242/18 G

*Primary Examiner*—Stanley N. Gilreath

*Attorney, Agent, or Firm*—Ronald C. Hudgens; Philip R. Cloutier; Greg Dziegielewski

[57] ABSTRACT

Apparatus adapted for the continuous collection of strands is provided wherein, a strand control assembly comprised of a plurality of plates having specific edged configurations is adapted to move a plurality of strands from their associated package collection regions to a temporary collection region and return the strands to the appropriate package collection regions automatically while the strands are continuously wound.

9 Claims, 16 Drawing Figures

APPARATUS FOR PACKAGING STRAND

TECHNICAL FIELD

The invention disclosed herein relates to improved apparatus for controlling a plurality of advancing strands as they are being collected in a multi-collet operation to permit continuous operation.

BACKGROUND ART

In the production of continuous glass fibers, it has been long desired to produce a winding system wherein the fibers are substantially continuously wound and attenuated. With the advent of winders having a plurality of driven rotatable collets mounted on an indexable head wherein each of the collets are capable of winding a plurality of packages thereon, the need for a fully automatic strand control system such that each of the strands are positioned and controlled to permit indexing of the collet between the package build and package doff positions with the subsequent repositioning of the strands in a proper package building region on the appropriate collet has greatly increased.

For example, U.S. Pat. Nos. 4,057,195 issued to Jones et al. on Nov. 8, 1977 and 4,085,901 issued to Sanders on Apr. 25, 1978 have provided some solutions in developing an automated winder for the continuous production of glass filaments.

DISCLOSURE OF THE INVENTION

This invention includes apparatus for packaging strand having a first driven rotatable collet having (a) a first primary collection region adapted to collect a first strand thereon, (b) a second primary collection region adapted to collect a second strand thereon, and (c) a temporary strand collection region; a second driven rotatable collet having (a) a first primary collection region adapted to collect the first strand thereon, (b) a second primary collection region adapted to collect the second strand thereon, and (c) a temporary strand collection region; an indexibly rotatable head having said first collet and said second collet journaled therein; wherein the improvement comprises: a first member adapted for movement along the first and second collets, said first member having a first edge and a first channel separated by a finger extending outwardly from said member; a second member adapted for movement along the first and second collets, said second member having a base edge and a second channel; and a third member located adjacent said first and second members, said first, second and third members being oriented such that (a) as said first and second members move along said collets said first strand being collected at said first primary collection region of said first collet and said second strand being collected at said second primary collection region of said first collet are moved to the temporary collection region of said first collet, said first and second strands being separated by said finger of said first member wherein said first strand is in contact with said first edge, said first and second strands being temporarily in contact with said base edge of said second member, (b) as said head is indexed, said second strand is captured in said first channel of said first member and in said second channel of said second member in the absence of capturing said first strand in said second channel, while said first and second strands are collected at said temporary collection region, and (c) as said first and second members are returned to the retracted position from the extended position said first strand is deposited at said first primary collection region of the second collet and the second strand is contacted by said third member to remove said second strand from said first channel and said second channel to deposit said second strand at said second primary collection region of said second collet to permit continuous collection such strands.

BEST MODE OF CARRYING OUT THE INVENTION

Figure 1:
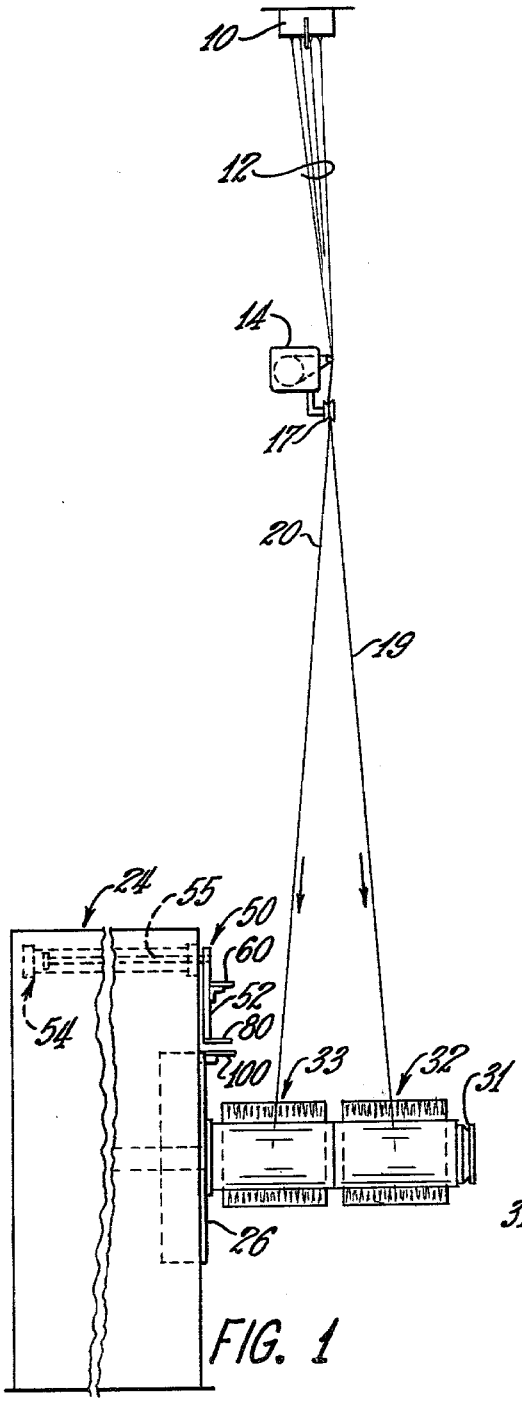
FIG. 1 is a side elevational view of a glass fiber/strand production and collection system according to the principles of this invention.
Figure 2:
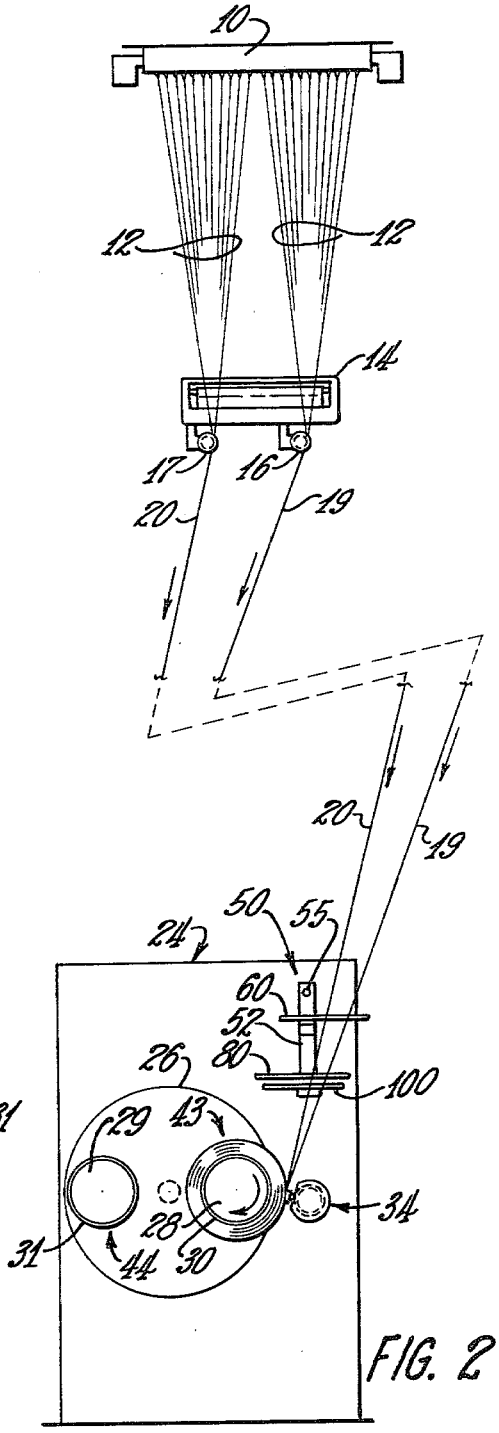
FIG. 2 is a front elevational view of the system shown in FIG. 1.

As shown in FIGS. 1 and 2, feeder 10 is adapted to supply a plurality of molten streams of thermoplastic material, such as glass, that are attenuated into filaments 12 through the action of winder 24 as is known in the art. Applicator 14 is adapted to apply a size or a coating to the advancing filaments 12. Intermediate applicator 14 and winder 24, first gathering shoe 16 and second gathering shoe or means 17 are adapted to separate and gather the individual filaments 12 into a first or front strand 19 and a second or rear strand 20 as is known in the art.

Winder or collection means 24 is comprised of an indexibly rotatable head or turret 26 and first collet 28 and second collet 29. Collets 28 and 29 are journaled for rotation in turret 26 and are associated with a suitable drive means to rotate said collets to wind the strands 19 and 20 thereabout as is known in the art.

As shown in FIG. 2, first collet 28 is in the package build position and second collet 29 is in the packaged doff position.

Traversing mechanism 34 having a strand guide associated with each strand, as is known in the art, is adapted to deposit first strand 19 at first package collection region 32 to build a helically wound first or front package 39. Similarly, traversing mechanism 34 is adapted to deposit second strand 20 along second package collection region 33 to build a helically wound second or rear package 40 as is known in the art.

Thus, each of the collets 28 and 29 have first and second package collection regions or primary collection regions associated therewith. In addition, first collet 28 incorporates a temporary collection region 30 at the distal end thereof. Temporary collection region 30 can be comprised of a groove and pin as is known in the art, such as disclosed in the aforementioned U.S. Pat. No. 4,057,915. Similarly, second collet 29 also incorporates a temporary collection region 31 at the distal end thereof.

As shown in FIG. 2, strand control assembly 50, which will be described in detail later herein, is positioned intermediate the collet at the package build position 43 and the gathering means 16 and 17.

In essence, the strand control assembly 50 cooperates with collets 28 and 29 and indexible head 26 to permit continuous filament/strand production and strand collection in an automatic mode.

Strand control assembly 50 is comprised of a first or upper movable member or plate 60, a second or lower movable plate or member 80 and a third or bottom member or plate 100. First plate 60 and second plate 80 are attached to arm 52 which is rigidly secured to rod 55 of motive means or air cylinder 54 secured to winder 24. Thus, rod 55 is adapted to move substantially parallel to the axis of rotation of the collets 28 and 29 to move strand control assembly 50 along therewith.

Figure 4:
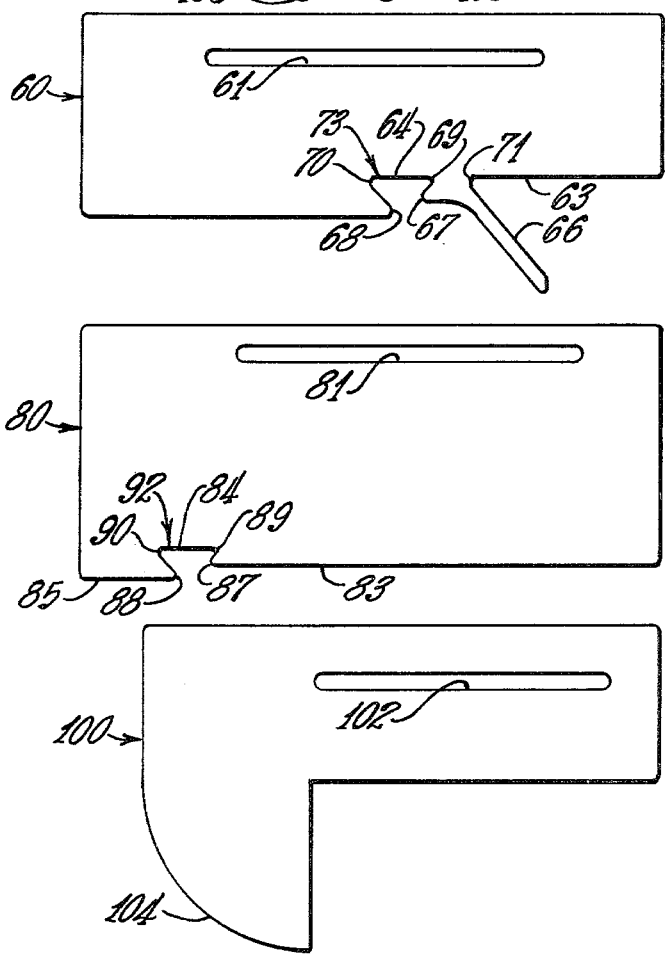
FIG. 4 is an exploded, enlarged view of the individual plates incorporated in the strand control assembly of FIG. 3.

In FIG. 4, the plates of strand control assembly 50 are shown in an exploded and unaligned planar view to permit full disclosure of the details of each of the plates. Further, FIG. 7, 10, 13 and 16 show plates 60 and 80 slightly out of alignment front to rear to show the approximate side to side relationship between various features of the plates.

Figure 6:
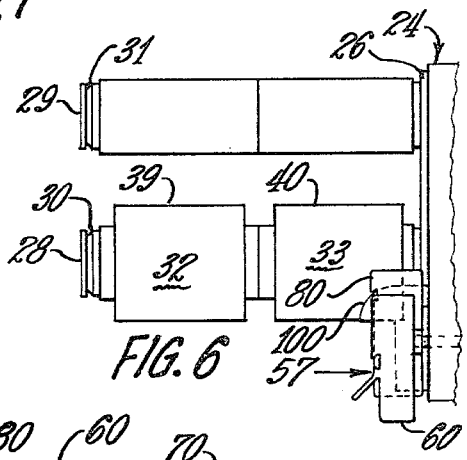
FIG. 6 is the plan view of the winder shown in FIG. 5.
Figure 9:
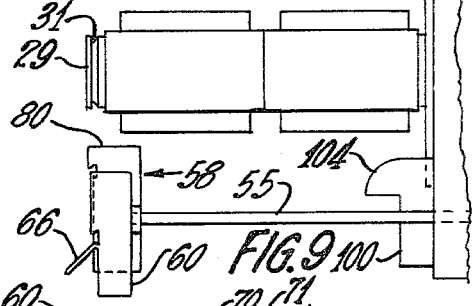
FIG. 9 is the plan view of the winder shown in FIG. 8.
Figure 12:
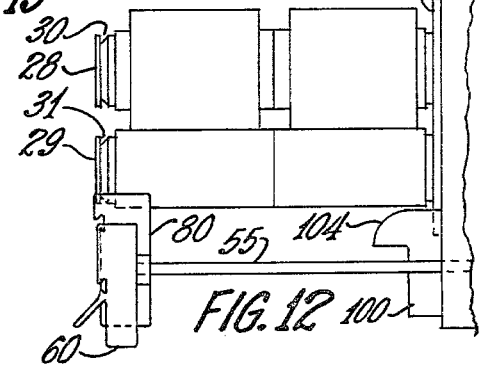
FIG. 12 is a plan view of the winder shown in FIG. 11.
Figure 15:
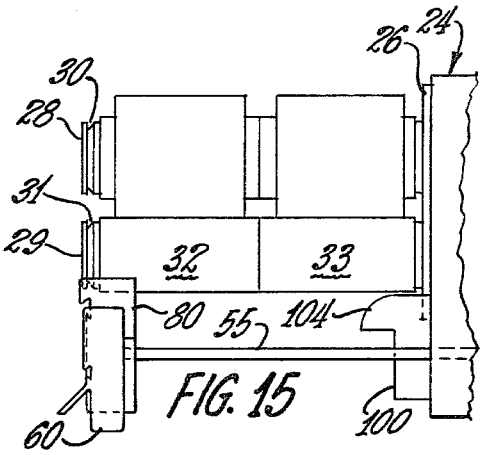
FIG. 15 is a plan view of the winder shown in FIG. 14.

FIG. 6 displays strand control assembly in the fully retracted position 57, and FIGS. 9, 12 and 15 show strand control assembly 50 in the fully extended position 58.

Figure 3:
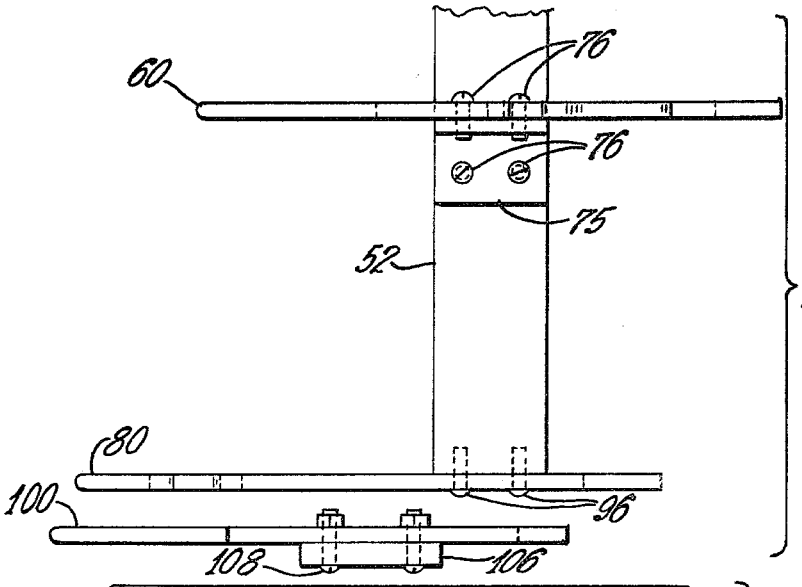
FIG. 3 is an enlarged front elevational view of the strand control assembly according to the principles of this invention.

As shown in FIGS. 3 and 4, first or upper plate 60 includes a slot 61 therethrough adapted to cooperate with bracket 75 and screws or fasteners 76 to fasten first plate 60 to arm 52 while permitting lateral translational adjustment of plate 60 in a vertical plane substantially perpendicular to the axis of rotation of the collets.

First plate also includes a first edge 63 and a second edge 64 at the distal end thereof. First edge 63 and second edge 64 can lie in a common plane.

Intermediate first edge 63 and second edge 64 finger 66 extends obliquely outwardly from the distal end of said plate to separate first edge 63 and second edge 64. First plate 60 can also include a first projection 67 located intermediate finger 66 and second edge 64. First projection 67 is oriented with respect to second edge 64 to form a first groove 69 therebetween.

First plate 60 also includes a second projection 68 opposite said finger 66 and first projection 67. Second projection 68 extends obliquely toward finger 66 to form a second groove 70 between second projection 68 and second edge 64.

Finger 66 is oriented at an acute angle with respect to first edge 63 to form a third groove 71 therebetween.

In essence, finger 66, second projection 68 and second edge 64 are oriented to form a first channel 73 having a second groove 70 therein.

As shown in FIGS. 3 and 4, second or lower plate or member 80 contains slot 81 which is adapted to accommodate screw-type fasteners 96 to fasten plate 80 to the distal end of arm 52. Thus, second plate 80 is located below first plate 60 and is also adapted to permit lateral adjustment thereof. At the distal end of second plate 80 base edge 83 is located in a plane intermediate recessed edge 84 and forward edge 85. Recessed edge 84 is the closest of edges 83, 84 and 85, when assembled, to arm 52.

First lip 87, located at one end of base edge 83 adjacent recessed edge 84, extends from base edge 83 toward second lip 88 to form a first grooved seat 89 between recessed edge 84 and first lip 87. At one end of forward edge 85, second lip 88 extends toward first lip 87 to form a second grooved seat 90 between recessed edge 84 and second lip 88.

In essence, recessed edge 84 in combination with first and second lips 87 and 88 form a second channel 92 having first and second grooved seats 89 and 90 therein. As shown in FIG. 4, second channel 92 is thus located at one end of base edge 83 and inwardly thereof.

As shown in the drawings, third or bottom member or plate 100 is substantially fixed to winder 24 by means of bracket 106 which cooperates with screw and nut type fasteners 108 which are accommodated by slot 102 of the third plate 100. Similar to slots 61 and 81, slot 102 permits lateral translational adjustment of third plate 100 in a plane substantially perpendicular to the axis of rotation of the collets.

Third plate 100 includes an oblique or arcuate edge 104 which is adapted to be aligned substantially directly under second channel 92 and first grooved seat 89 of second plate 80.

As can be seen in the drawings, a portion of first edge 63 of first plate 60 and first channel 73, including first and second grooves 69 and 70, are located substantially directly above base edge 83 of second plate 80 when the plates are secured in their final position with respect to arm 52. Further, second channel 92, including first and second grooved seats 89 and 90 lies within a vertical plane between a vertical plane containing the axis of rotation of a collet at the package build position 43 and a vertical plane containing first channel 73.

Figure 5:
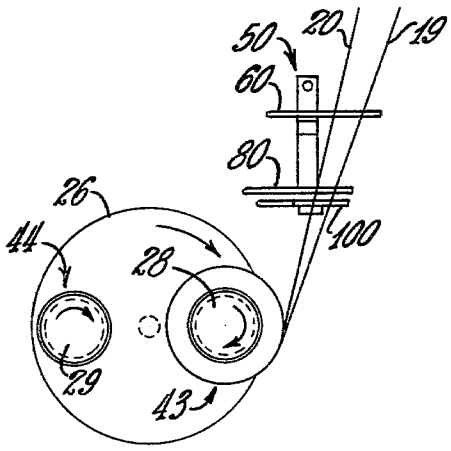
FIG. 5 is a frontal view of a winder having the collets thereon in a first position.
Figure 7:
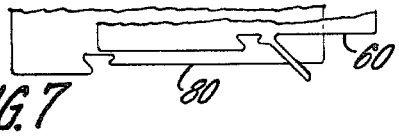
FIG. 7 is an enlarged plan view of a portion of the strand control assembly shown in FIG. 6.

In operation, just prior to the cessation of the package build mode as shown in FIGS. 5, 6 and 7, strand control assembly 50 is in the fully retracted position 57.

At a predetermined time, strand control assembly 50 is moved along the axis of rotation of collet 28 such that first strand 19 and second strand 20 are separated by finger 66. That is, strand 19, as viewed in plan, passes to the right of finger 66 while strand 20 may engage finger 66 and slides therealong to second edge 64.

As strand control assembly 50 continues to move outwardly along the axis of rotation of collet 28 the strands 19 and 20, associated with first and second packages 39 and 40, are moved laterally along collet 28 and into the temporary collection region 30 to be wound therein. Once strand control assembly 50 is in the fully extended position, turret 26 can be rotated to complete the strand transfer.

Figure 8:
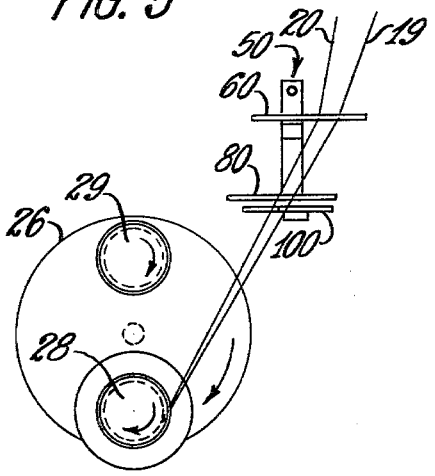
FIG. 8 is a front elevational view of the winder wherein the collets are at a second position during indexing to transfer the strands.
Figure 10:
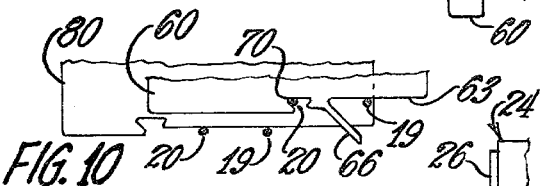
FIG. 10 is an enlarged plan view of a portion of the strand control assembly shown in FIG. 9.

FIGS. 8, 9 and 10 depict the turret 26 at a point approximately one-half through the rotation sequence wherein the collet 28 is moved from the package build position 43 to the packaged doff position 44 and conversely collet 29 is moved from the packaged doff position to the package build position. Both strands 19 and 20 are being wound around the temporary collection region 30 of collet 28 at this time.

First strand 19, which is associated with the first or front package or primary collection region 32, is in contact with first edge 63 of first plate 60 and base edge 83 of second plate 80. Simultaneously, second strand 20, which is associated with the second package or primary colletion region 33, is positioned in second groove 70 of first plate 60 and base edge 83 of second plate 80.

As turret 26 continues to rotate, strands 19 and 20 continue to slide along base edge 83 of second plate 80 toward second channel 92. Similarly, first strand 19 moves along first edge 63 toward third groove 71 of first plate 60 and second strand 20 moves to second groove 70 of first channel 73 of first plate 60.

Figure 11:
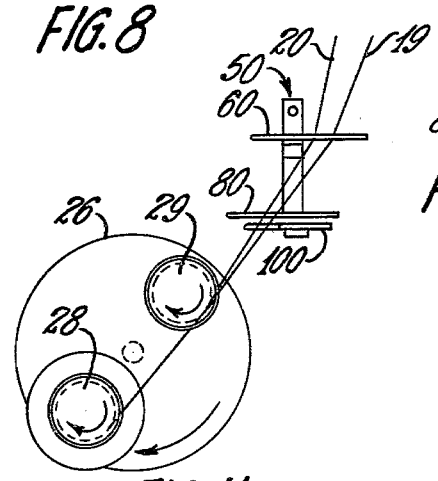
FIG. 11 is a front elevational view of a winder at a third position, also during the indexing mode.
Figure 13:
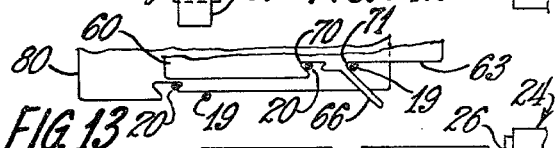
FIG. 13 is an enlarged plan view of a portion of the strand control assembly shown in FIG. 12.

As shown in FIGS. 11, 12 and 13, turret 26 has rotated to a point at which the strands 19 and 20 will be laterally moved along the edges of strand control assembly 50 to their, approximately, most extreme point. At that point, strands 19 and 20 will be caught automatically in the temporary collection region 31 of second collet 29 and will begin to wind thereabout. As is known in the art, the segments of strands between collets 28 and 29 will automatically fracture when the collets 28 and 29 and turret 26 are positioned at the point of strand transfer between collets.

At the point of most extreme lateral displacement for the strands 19 and 20 with respect to the edges of strand control assembly 50, as shown in FIGS. 11, 12, and 13, second strand 20 drops into second channel 92 along recessed edge 84 in the absence of first strand 19 doing likewise. That is, second strand 20 is positioned in second channel 92 of second plate 80 while first strand 19 remains in contact with base edge 83.

With respect to first plate 60, first strand 19 is positioned in third groove 71 while second strand 20 is positioned in second groove 70 therein.

As turret 26 rotates beyond the point of strand transfer between the collets, second strand 20 is urged into first grooved seat 89 of second plate 20. Thus, second strand 20 is captured in second groove 70 of first plate 60 and first grooved seat 89 of second plate 80 when the turret 26 is fully indexed to bring collet 29 into the package build position 43. At that time, first strand 19 is located along first edge 63 and/or first groove 69 of first plate 60 and along base edge 83 of second plate 80.

Figure 14:
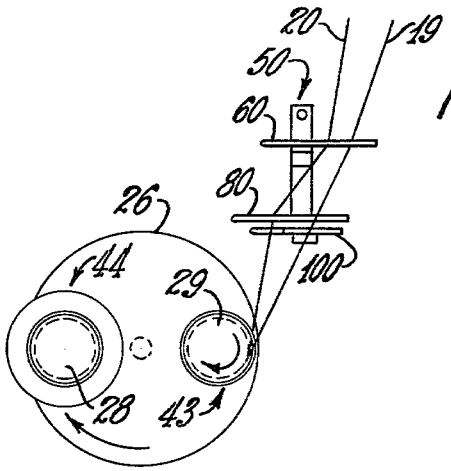
FIG. 14 is a front elevational view of a winder wherein the full package has been moved to the doff position and the empty collet has moved into the package build region.
Figure 16:
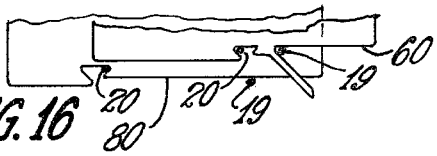
FIG. 16 is an enlarged plan view of a portion of the strand control assembly shown in FIG. 15.

With the turret 26 fully indexed as shown in FIGS. 14, 15 and 16, strand control assembly is ready to move back to the retracted position 57. It is to be noted that first plate 60 and second plate 80 are positioned on arm 52 such that first edge 63 and second edge 64 of first plate 60 and base edge 83, recessed edge 84 and forward edge 85 of second plate 80 are positioned outwardly beyond a vertical plane containing temporary collection regions 32 and 33 when the strand control assembly is in the fully extended position.

As strand control assembly moves toward the retracted position, first strand 19 is moved inwardly along collet 29 until strand 19 is captured by the strand guide of traversing mechanism 34 associated with first package collection region 32. At that point, strand 19 is free of strand control assembly 50.

Strand 20, however, due to the fact that strand 20 is still captured in second groove 70 and first grooved seat 89, continues to be pulled inwardly along collet 29, whereupon second strand 20 engages oblique edge 104 of third plate 100, which is adapted to move second strand 20 laterally along recessed edge 84, until strand 20 is released from second channel 92. At that time, strand 20 is also released from first channel 73 and is captured by the second strand guide of traversing mechanism 34 which is associated with the second package collection region 33. Thus, first strand 19 has been deposited at the first primary or package collection region 32 and second strand 20 has been deposited at the second primary or package collection region 33 to be helically wound into packages by driven rotatable collet 29 and traversing mechanism 34.

Thus, the plurality of strands have been removed from and returned to their associated package collection regions automatically while continuously producing the continuous fibers 12.

It is to be understood that third plate 100 may also be movable and need not be strictly confined to a position below first plate 60 and second plate 80. That is, third plate 100 may also be movable, via an air cylinder or the like, and/or may be located intermediate first plate 60 and second plate 80 or even above first plate 60. If need be, a fourth plate (not shown) may work in conjunction with third plate 100 to knock strand 20 from the first and second channel 73 and 92, respectively, if needed.

Strand control assembly 50 can be suitably interconnected with winder 24 by means of conventional electrical, mechanical and/or pneumatic means as is known in the art to sequentially operate as disclosed herein.

At initial start-up, it may be necessary for the operator to manually assist the system to engage the strands in the proper grooves and/or edges of control system 50. Once properly positioned, the present invention permits automatic operation of the fiber forming and collection system.

It is apparent that within the scope of the invention, modifications and different arrangements can be made other than as herein disclosed. The present disclosure is merely illustrative with the invention comprehending all variations thereof.

INDUSTRIAL APPLICABILITY

The invention described herein is readily applicable to the formation and collection of continuous fibers and strand, such as glass.

We claim:

1. In apparatus for packaging strand having:

a first driven rotatable collet having (a) a first primary collection region adapted to collect a first strand thereon, (b) a second primary collection region adapted to collect a second strand thereon, and (c) a temporary collection region;

a second driven rotatable collet having (a) a first primary collection region adapted to collect the first strand thereon, (b) a second primary collection region adapted to collect the second strand thereon, and (c) a temporary collection region;

an indexible head having said first collet and said second collet journaled therein; wherein the improvement comprises:

a first member adapted for movement along the first and second collets, said first member having a first edge and a first channel separated by a finger extending outwardly from said member;

a second member adapted for movement along the first and second collets, said second member having a base edge and a second channel;

and a third member located adjacent said first and second members, said first, second and third members being oriented such that (a) as said first and second members move along the collets the first strand being collected at the first primary collection region of the first collet and the second strand being collected at the second primary collection region of the first collet are moved to the temporary collection region of the first collet, the first and second strands being separated by said finger of said first member wherein the first strand is in contact with said first edge, said first and second strands being in contact with said base edge of said second member, (b) as said head is indexed, said second strand is captured in said first channel of said first member and in said second channel of said second member in the absence of capturing said first strand in said second channel, while the first and second strands are collected at the temporary collection region, and (c) as said first and second members are returned to the retracted position from the extended position the first strand is released to engage the first primary collection region of the second collet and the second strand is contacted by said third member to remove said second strand from said first channel and said second channel such that said second strand engages the second primary collection region of the second collet to permit continous collection of such strands.

2. The apparatus of claim 1 wherein said first and second members are plates.

3. The apparatus of claim 2 wherein said third member is a plate.

4. The apparatus of claim 3 wherein said third member is fixed.

5. The apparatus of claims 1 or 2 wherein said third member is located intermediate said collets and said first and second members.

6. The apparatus of claim 1 wherein said first, second, and third members are laterally adjustable to permit the desired strand alignment.

7. The apparatus of claim 1 wherein said second channel is located intermediate the vertical planes defining said first channel and the axis of rotation of one of said collets.

8. The apparatus of claims 1 or 7 wherein said first edge, said first channel, said base edge and said second channel are positioned outwardly beyond a vertical plane defining the temporary collection region of the collets.

9. In apparatus for packaging strand having:

a first driven rotatable collet having (a) a first primary collection region adapted to collect a first strand thereon, (b) a second primary collection region adapted to collect a second strand thereon, and (c) a temporary strand collection region;

a second driven rotatable collet having (a) a first primary collection region adapted to collect the first strand thereon, (b) a second primary collection region adapted to collect the second strand thereon, and (c) a temporary strand collection region;

a rotatable head having said first collet and said second collet journaled therein; wherein the improvement comprises:

a first plate adapted for movement substantially parallel to the axes of rotation of said first and second collets, said first plate having a first edge and a second edge separated by a finger extending obliquely outwardly from said first edge and said second edge, said first plate also having a first projection located intermediate said finger and said second edge oriented to form a first groove between said first projection and said second edge, said first plate also having a second projection extending obliquely toward said finger to form a second groove between said second projection and said second edge;

a second plate adapted for movement along the axes of rotation of said first and second collets, said second plate having a base edge, a recessed edge, a first lip and a second lip, said base edge being positioned within a plane intermediate said recessed edge and said second lip, said first lip extending from said base edge towards said second lip to form a first grooved seat between said recessed edge and said first lip, said second lip extending obliquely toward said first lip to form a second grooved seat between said recessed edge and said second lip; and a third plate positioned below said first and second plates, said third plate having an oblique edge extending outwardly therefrom, said first, second and third plates being oriented such that (a) as the said first and second plates move from a retracted position toward an extended position the first strand being collected at the first primary collection region of said first collet and the second strand being collected at the second primary collection region of said first collet are moved to the temporary collection region of the first collet, said first and second strands being separated by said finger of said first member wherein the first strand is in contact with said first edge, the first and second strands being at least temporarily in contact with said base edge of said second plate, (b) as the head is indexed, the second strand is captured in said second groove of said first plate and said first grooved seat of said second plate in the absence of capturing said first strand in said first grooved seat, and (c) as said first and second plates are returned to the retracted position from the extended position the first strand is deposited at said first primary collection region of the second collet and the second strand is contacted by said third plate to remove said second strand from said second groove and said first grooved seat to deposit said second strand at said second primary collection region of said second collet to permit continuous collection of such strands.

* * * * *